US009640057B1

(12) United States Patent
Ross

(10) Patent No.: US 9,640,057 B1
(45) Date of Patent: May 2, 2017

(54) PERSONAL FALL DETECTION SYSTEM AND METHOD

(71) Applicant: MedHab, LLC, Mansfield, TX (US)

(72) Inventor: Johnny Ross, Mansfield, TX (US)

(73) Assignee: Medhab, LLC, Mansfield, TX (US)

( * ) Notice: Subject to any disclaimer, the term of this patent is extended or adjusted under 35 U.S.C. 154(b) by 0 days.

(21) Appl. No.: 14/948,752

(22) Filed: Nov. 23, 2015

(51) Int. Cl.
*G08B 23/00* (2006.01)
*G08B 21/04* (2006.01)

(52) U.S. Cl.
CPC ..... *G08B 21/0446* (2013.01)

(58) Field of Classification Search
None
See application file for complete search history.

(56) References Cited

U.S. PATENT DOCUMENTS

| | | | |
|---|---|---|---|
| 5,515,858 | A | 5/1996 | Myllymaki |
| 6,160,478 | A | 12/2000 | Jacobsen |
| 6,968,294 | B2 | 11/2005 | Gutta et al. |
| 8,217,795 | B2 | 7/2012 | Carlton-Foss |
| 8,647,268 | B2 | 2/2014 | Tran |
| 8,655,618 | B2 | 2/2014 | Flaction et al. |
| 8,680,991 | B2 | 3/2014 | Tran |
| 8,742,935 | B2 | 6/2014 | Cuddihy et al. |
| 8,952,818 | B1 | 2/2015 | Zhang |
| 2006/0282021 | A1 | 12/2006 | Devaul |
| 2009/0270743 | A1 | 10/2009 | Dugan et al. |
| 2010/0033303 | A1 | 2/2010 | Dugan et al. |
| 2013/0135097 | A1 | 5/2013 | Doezema |
| 2014/0118139 | A1* | 5/2014 | DeMont ..... G08B 21/02 340/539.12 |
| 2014/0143064 | A1* | 5/2014 | Tran ..... A61B 5/0022 705/14.66 |
| 2014/0276239 | A1 | 9/2014 | Subramaniam et al. |

FOREIGN PATENT DOCUMENTS

| | | |
|---|---|---|
| WO | WO2010108287 | 9/2010 |
| WO | WO2015042487 | 3/2015 |

* cited by examiner

*Primary Examiner* — Adolf Dsouza
(74) *Attorney, Agent, or Firm* — Eric Karich; Karich & Associates

(57) ABSTRACT

A computer-implemented system and method for detecting a fall includes a wearable device with an accelerometer and a transmitter for transmitting data to a portable electronic device. The method comprises receiving data from the accelerometer in response to a movement of the wearable device; transitioning between operational states in a plurality of operational states based on the received data and time elapsed since a last state transition; and detecting falling of the person based on a predefined sequence of state transitions including at least one transition to a falling state having the data being equivalent to zero, where the time elapsed at the falling state exceeds a predefined maximum time threshold.

15 Claims, 7 Drawing Sheets

PERSONAL FALL DETECTION SYSTEM AND METHOD

BACKGROUND OF THE INVENTION

Field of the Invention

This invention relates generally to monitoring systems, and more particularly to personal monitoring systems that are used to track a person's movements for detecting if the person has fallen and may have been injured.

Description of Related Art

Various care systems exist for monitoring a person's movements. Some systems monitor the movements of the elderly and persons with medical conditions; and such monitoring allows for timely interventions by those who are responsible for diagnosing, caring, rescuing, treating, or otherwise assisting such individuals. There are also many systems for monitoring young and uninjured persons, for tracking daily habits, activity levels, and similar data (e.g., steps taken during the day, calories burned, hours of sleep, etc.). Examples of prior art systems are as follows:

Devaul, U.S. 2006/0282021, teaches a motion analysis telemonitor system that includes a wearable monitoring device that monitors the activity level and movements of a person wearing the device. The wearable monitoring device is used to track fire-fighters, and is able to determine whether the person has fallen through a model analysis technique using characteristic movements of a fall. The wearable device generally transmits data and alerts over a short distance to a console. The console, in turn, transmits data and alerts to a monitoring center. The motion analysis telemonitor system is also able to monitor progression of a disease through changes in movement, which can indicate fatigue.

Devaul teaches the use of "Bayes Theorem" to assist in determining classification of any movement into a model, to assist in determining whether a movement is a fall (or similar situation) or regular movement. This system also includes ancillary components, such as a GPS system, a dead reckoning system, and other components, and may be used in conjunction with a cell phone or similar electronics device.

Jacobsen, U.S. Pat. No. 6,160,478, teaches a health monitoring system for monitoring the elderly which uses wristbands having accelerometers. The system alerts caregivers in the event of a fall. While Jacobson does not teach the use of artificial intelligence, it instead looks for "spikes" in movement that may indicate a fall, especially if followed by a period of the person remaining prone and/or not moving.

Carlton-Foss, U.S. Pat. No. 8,217,795, teaches a fall detection system that includes a wearable monitoring device that monitors the movement of a person, and may be worn on the wrist or other suitable location. The device monitors a sensor (e.g., accelerometer) and detects variation from the normal range and duration thereof. The system determines whether the wearer has fallen through an algorithmic analysis technique using parameters to evaluate the accelerations and timings of the events that comprise a fall. If the combination of the timing and variations from the normal ranges are sufficient as compared to preset thresholds, a fall report will be generated. The wearable device optionally allows qualified professionals to adjust or customize the parameters to optimize the evaluation to the requirements of particular users or classes of users. The wearable device generally transmits data and alerts over a short distance to a console or over a long distance using a connection to a long-distance back haul communication system such as cell network or internet or both. The device thus transmits data and alerts to a call center or other designated location.

Zhang, U.S. Pat. No. 8,952,818, teaches a wearable fall detection device configured for monitoring a wearer of the device. The device comprises a first sensor configured to generate elevation data that represents an elevation of the device, and a second sensor configured to generate acceleration data that represents a magnitude of acceleration of the device. The device also includes a processor configured to determine, based on the elevation data, an elevation of a floor located underneath the wearer, and detect a fall affecting the wearer. Detecting a fall may be done by determining that the acceleration data satisfies a fall hypothesis condition, and determining, based on the elevation data, that the apparatus is vertically displaced from the floor by less than a threshold distance.

Doezema, U.S. 2013/0135097, teaches a wearable, hands-free emergency alert device that responds automatically to a measurable physical effect of a fall event by the wearer to send an alert signal to a remote responder. The wearable device may be a bracelet with a flex circuit including an accelerometer; a manual alert to signal non-fall emergencies; a microphone and/or audio chip for voice communications between the user of the wearable device and a remote responder; one or more charging contacts so as to allow for induction and/or wireless charging of the device; and a wireless transmitter capable of sending a wireless alert signal in response to a sensed fall and capable of generating a response signal in response to receipt of a ping signal which may be used to determine the device's location.

Luo, W.O. 2010108287, teaches a wearable intelligent healthcare system for monitoring a subject and providing feedback from physiological sensors, activity sensors, a processor, a real-time detection and analyzing module for continuous health and activity monitoring, adjustable user setting mode with the adaptive optimization, data-collecting capability to record important health information, audio outputs to the user through audio path and audio interface, preset and user confirmable alarm conditions via wireless communications network to the appropriate individual for prompt and necessary assistance. The system uses noninvasive monitoring technology for continuous, painless and bloodless health state monitoring. The system works through the short range wireless link with carry-on mobile unit for displaying health information, making urgent contact to support center, doctor or individual, and for information transmission with a healthcare center.

While the prior art teaches various related systems and method, the prior art fails to teach a system and method with the novel and non-obvious elements and improvements that are claimed in the present application.

SUMMARY OF THE INVENTION

The present invention teaches certain benefits in construction and use which give rise to the objectives described below.

One embodiment of the present disclosure includes a computer-implemented system and method for detecting falling of a person during a physical activity, where the person is in communication with a wearable device having an accelerometer and a transmitter for transmitting data from the accelerometer. The method comprises the steps of receiving data from the accelerometer in response to a movement of the wearable device; transitioning between operational states in a plurality of operational states based on the received data and time elapsed since a last state transition; and detecting falling of the person based on a predefined sequence of state transitions including at least one transition to a falling state having the data being equivalent to zero, where the time elapsed at the falling state exceeds a predefined maximum time threshold.

In one embodiment, the system and method further tracks physical activities of a user, such as rehabilitation exercises performed by the user. The system reports the physical activities to a central server for the purposes of monitoring and reporting on the activities of the user.

A primary objective of the present invention is to provide a personal monitoring system having advantages not taught by the prior art.

Another objective is to provide a personal monitoring system that is able to reliably detect a fall of a user.

Another objective is to provide a personal monitoring system that tracks physical activities of a user, such as rehabilitation exercises performed by the user, and reports the physical activities to a central server for the purposes of monitoring and reporting on the activities of the user.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The advantages and features of the present invention will become better understood with reference to the following more detailed description taken in conjunction with the accompanying drawings in which.

DETAILED DESCRIPTION OF THE INVENTION

Figure 1:
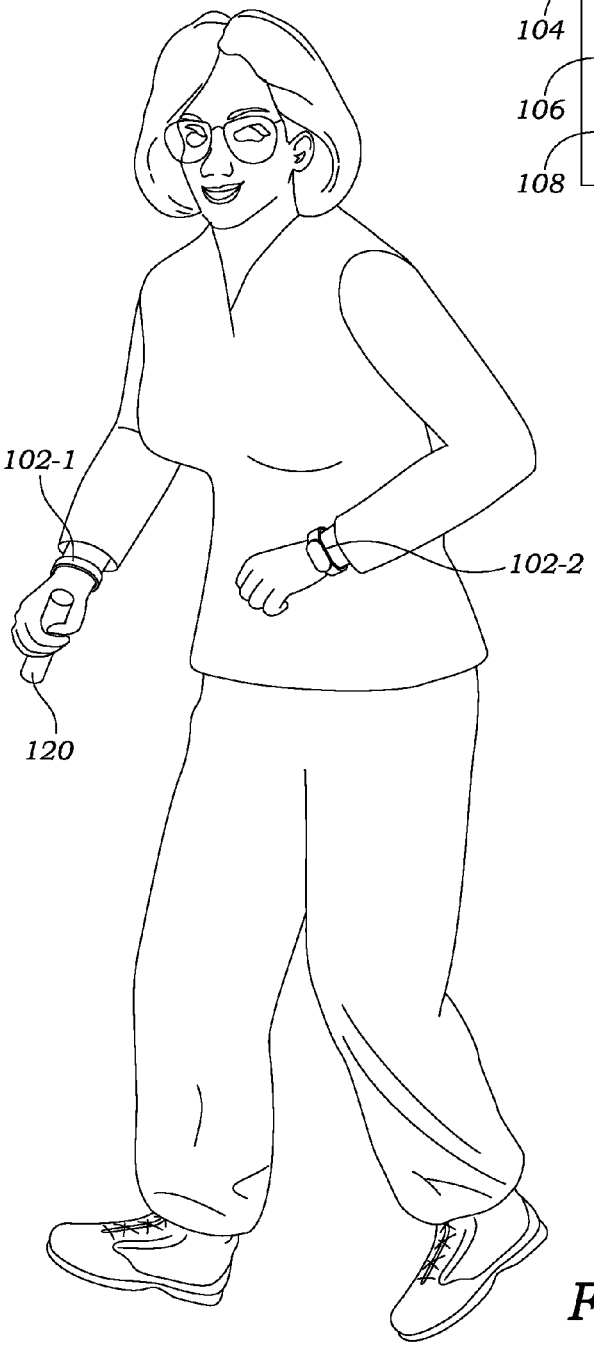
FIG. 1 is a perspective view of a user wearing two wearable sensor devices and carrying a portable electronic device, according to one embodiment of the present invention.

FIG. 1 is a perspective view of a user wearing wearable sensor devices 102, in this embodiment wrist bands worn on each of the user's wrists. The user is also carrying a portable electronic device 120, which in this case is in the form of a smart phone. This system enables the user to be monitored at all times, for multiple purposes.

First, the user is monitored at all times for the purposes of detecting falls and other traumatic events that may require urgent medical care. The details of this process are described in greater detail below.

Second, the user is monitored for detecting, monitoring, and reporting physical activities. The user is monitored while performing a set of predefined physical activities, which, for example, may be prescribed by a health practitioner or a fitness trainer. For example, an elderly woman may perform various exercises prescribed by a doctor for routine body movement and healthy lifestyle. During such exercises, the elderly woman may wear one or more of the sensor devices 102-1 and 102-2 (collectively, wearable sensor devices 102) for being monitored to ensure adherence to the prescribed exercise schedule and inform caregivers or rescuers in case of falling during the exercises. The wearable sensor devices 102 may operate in communication with the personal electronic device 120 to track the user, detect if the user has fallen, and report any deviation from the prescribed set of physical activity or falling of the user.

Figure 2:
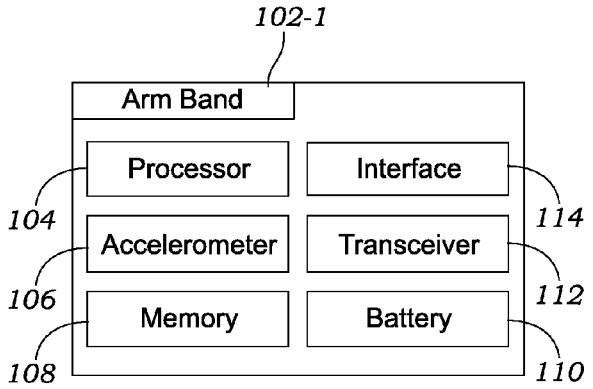
FIG. 2 is a block diagram of operable components of a wearable sensor device of FIG. 1, according to one embodiment of the present invention.

FIG. 2 is a block diagram that illustrates electronic components of the wearable sensor devices 102. As illustrated in FIG. 2, the wearable sensor device 102 may be appropriately shaped and adapted into any wearable device (e.g., a wrist band, arm band, head band, belt, article of clothing, etc.). In one embodiment, the wearable sensor devices 102-1 includes a printed circuit board ("PCB") (not shown) having or being operably attached to a computer processor 104, a computer memory 108, and a battery 110.

Each of the components may be operably connected to the processor 104 by electrical connectors or any other operative connection known in the art, related art, or developed later. The processor 104 and the memory 108 may be any form of processor or processors, memory chip(s) or devices, microcontroller(s), and/or any other devices known in the art, related art, or developed later.

The battery 110 supplies power to the processor 104. The battery 110 may be rechargeable which can be charged by an external power source, or in alternative embodiments it may be replaceable. The wearable sensor devices 102 may further include an inductive charging coil (not shown) which may be operably mounted adjacent the battery 110 and/or the PCB. The inductive charging coil is used to charge the battery 110 by using an external inductive charger (not shown). Other devices or systems known in the art for supplying power may also be utilized, including various forms of charging the battery 110, and/or generating power directly using piezoelectric, solar, or other devices.

The wearable sensor devices 102 may further include one or more accelerometers 106, one or more micro-electro-mechanical-systems "MEMS" gyroscopes (not shown), and/or a compass (not shown) to record movement, rotation, and direction data respectively and supply the data to the processor 104. The accelerometer 106, the gyroscope (not shown), and the compass (not shown) may be operably connected to the processor 104 via being operably mounted on the PCB, or they may be mounted elsewhere and connected via the wires. In view of the present embodiment, the gyroscope and the compass are optional.

The integrated motion tracker including the accelerometer 106 provides data on the linear acceleration in three linear dimensions, roll, pitch, yaw, position, bearing, and heading. These nine coordinate measurements provide a complete description of the motion and position of the user. Other motion trackers may also be used by those skilled in the art and are within the scope of the present invention.

The processor 104 may also include the memory to store data collected by the accelerometer 106, and a transceiver 112 to transmit and receive signals for communication between the processor 104 and external computing devices enabled to send and receive the signals. The processor 104, the memory 108, and the transceiver 112 may all be mounted on the PCB, or in other suitable locations as determined by one ordinarily skilled in the art. The transceiver 112 may communicate via local communications protocols such as Bluetooth®, cellular networks, WIFI, and/or any other communications standards known in the art.

Figure 4:
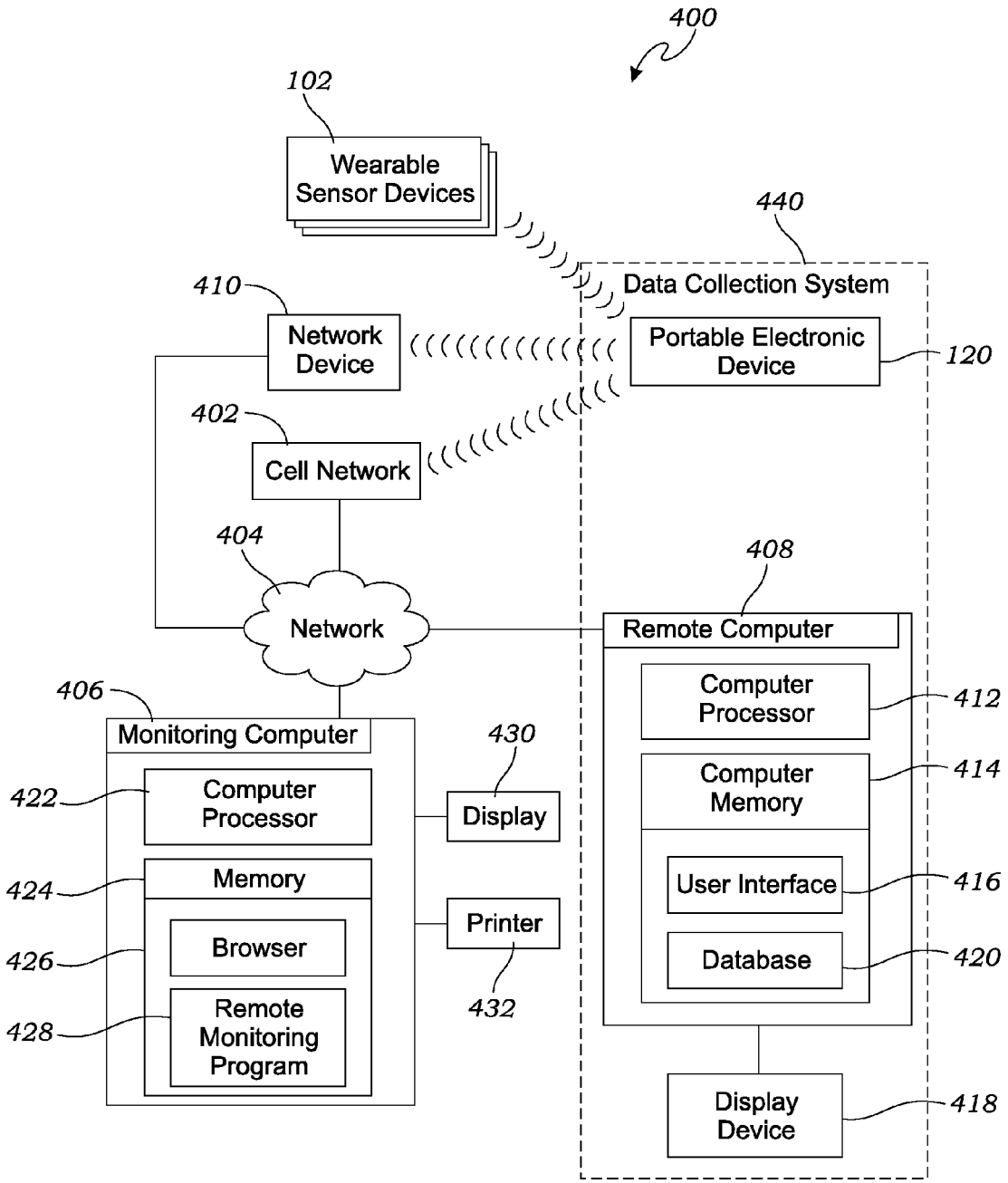
FIG. 4 is a block diagram of one embodiment of an exemplary personal monitoring system that includes the portable electronic device, a monitoring computer, and a remote computer for monitoring the personal monitoring system and storing data, according to one embodiment of the present invention.

As the user wearing the wearable sensor devices 102 performs a physical activity (e.g., running, walking, climbing stairs, sitting, jogging, routine or prescribed exercises, push-ups, sit-ups, cycling, etc.), acceleration data from the accelerometer 106 may be collected by the processor 104 for use in a variety of ways. The data may correspond to any change in acceleration of the wearable sensor devices 102 across X, Y, and Z axes with respect to the gravity of earth due to the physical activity being performed by the user. The wearable sensor devices 102 may use the transceiver 112 to connect and transfer data from the wearable sensor devices 102 to a local computer (e.g., the portable electronic device 120) and/or remote computer (408, as shown in FIG. 4), and/or monitoring computer (406, as shown in FIG. 4). The data may be transmitted by the transceiver 112, which is defined to include any device known to those ordinarily skilled in the art that are functional for this purpose. In particular, the data may be transferred in packets or bundles, containing multiple bytes or bits of information. The bundling of the data may be performed according to those ordinarily skilled in the art for optimizing the data transfer rate between the wearable sensor devices 102 and any remote receiver. Alternatively in another embodiment, the data may be reported via a separate reporting device (not shown) worn by the user, located nearby, or located remotely. In another embodiment, the data may also be used to compare with a threshold value and take a predefined action based on the comparison. The data may be received, collected, reviewed, and utilized using different forms of computer devices such as the portable electronic device 120.

Figure 3:
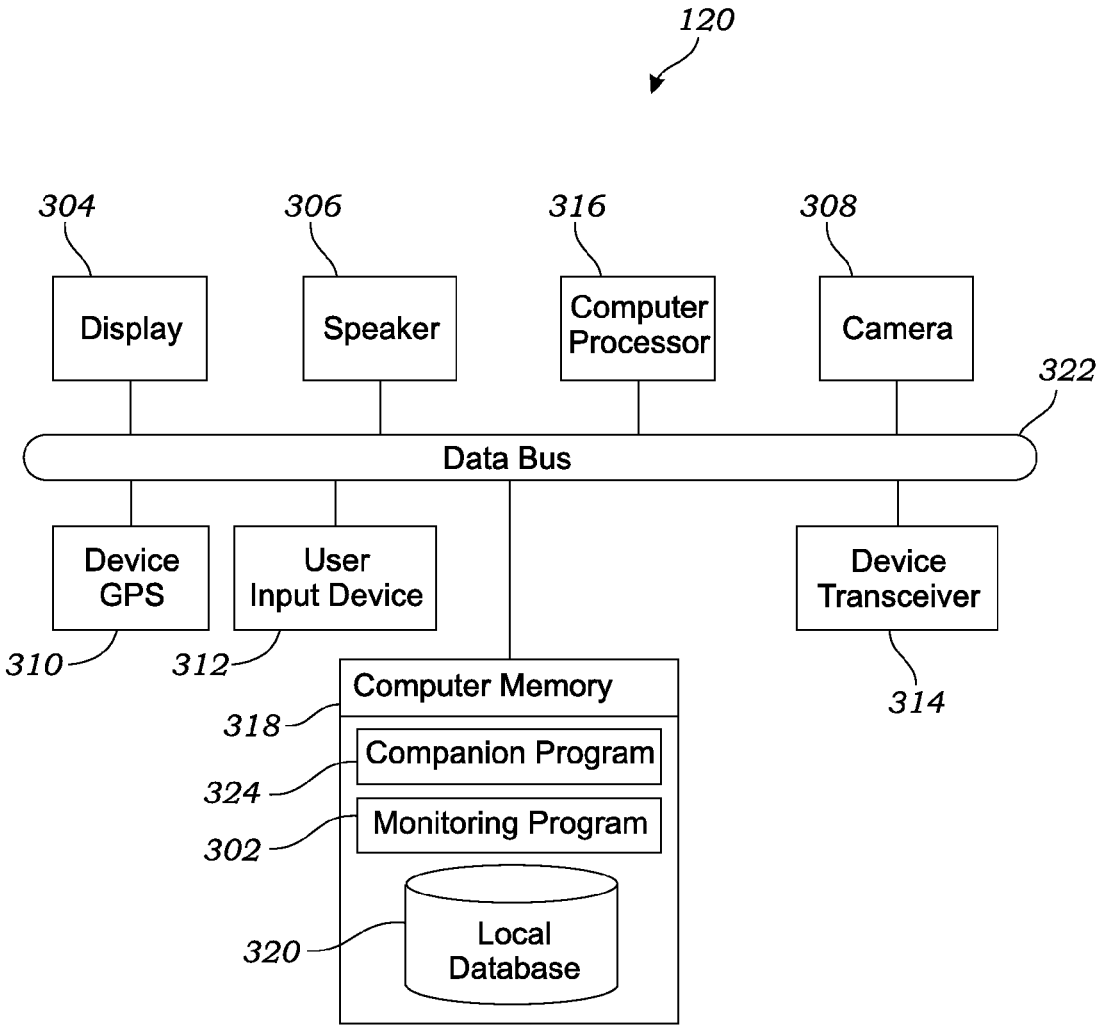
FIG. 3 is a block diagram of operable components of the portable electronic device of FIG. 1, according to one embodiment of the present invention.

FIG. 3 is a block diagram of operable components of the portable electronic device 120 of FIG. 1, according to one embodiment of the present invention. The portable electronic device 120 of this embodiment is a smart phone that includes a monitoring app 302 installed thereupon. The application, or "app," is a computer program that may be downloaded and installed using methods known in the art. The app enables the user to monitor their movement as detected and analyzed by the wearable sensor devices 102 and to communicate with the portable electronic device 120 to aid in executing proper physical motions. In the discussion of FIG. 3, we will begin with a description of the components of the portable electronic device 120, as they relate to the present invention. Then we will discuss in greater detail the functionality of the monitoring app 302, in one example, an embodiment used for physical therapy, and in another example, an embodiment for being used by a user performing a physical activity.

The portable electronic device 120 may include various electronic components known in the art for this type of device. In this embodiment, the portable electronic device 120 may include a device display 304, a speaker 306, a camera 308, a device global positioning system ("GPS") 310, a user input device 312 (e.g., touch screen, keyboard, microphone, and/or other form of input device known in the art), a user output device (such as earbuds, external speakers, and/or other form of output device known in the art), a device transceiver 314 for wireless communication, a computer processor 316, a computer memory 318, a monitoring app 302 operably installed in the computer memory 318, a local database 320 also installed in the computer memory 318, and a data bus 322 interconnecting the aforementioned components. For purposes of this application, the term "transceiver" is defined to include any form of transmitter and/or receiver known in the art, for cellular, WIFI, radio, and/or other form of wireless (or wired) communication known in the art. Obviously, these elements may vary, or may include alternatives known in the art, and such alternative embodiments should be considered within the scope of the claimed invention.

As shown in FIG. 3, the speaker 306 is typically integrated into the portable electronic device 120, although the speaker 306 may also be an external speaker. The speaker 306 may be used to give the user audio feedback and instructions to the user during use of the system, such as while exercising, etc. The speaker 306 may be any sort of speaker, known by those skilled in the art, capable of transforming electrical signals to auditory output.

In some embodiments, the monitoring app 302 monitors a user performing a physical activity such as walking, or any forms of stretches, exercises, rehabilitation routines, etc., and displays the physical activity in real time on the display 304 (defined to include near-real time, with a slight delay for computer processing, transmission, etc.). This display may be used to provide feedback to assist the user in performing the exercises correctly, and to provide encouragement to perform them as fully and correctly as possible.

The monitoring app 302 operably installed on the portable electronic device 120 may perform multiple tasks. In one example, a digital model (not shown) of the user may be generated and displayed on the computer display 304 of the portable electronic device 120. Movement of the digital model may be displayed, in real time, based upon the data received from the accelerometer 106, so that the digital model of the user approximates the movement of the user performing the physical activity.

This enables the user to watch himself/herself performing the physical activity, to better determine whether they are being performed correctly. The display may also be transmitted to other computer devices, such as a doctor, trainer, caretaker, etc., so that they may monitor the activities and take corrective action if required.

The movement of the digital model may also be compared with a preferred movement model of the monitoring app 302, to determine if the actual movement of the user approximates the preferred movement model, or if correction is needed. Communication with the user, in real time, with corrective instructions may be provided when correction is needed. Corrective instructions may include audio, text, video (e.g., video of the exercise being correctly performed), haptic, and/or any other medium desired to assist the user in performing the exercises such as running (or other activities) correctly.

Another synergistic use of the monitoring app 302 with common portable electronic device 120 is that the monitoring app 302 may be continuously calibrated by using the camera 308 of the portable electronic device 120 and common motion capture software. In this instance, if the motion capture determined that both the user's feet were on the ground, but for some reason the monitoring app 302 reported that the user's feet were not at the same level, the position of the user's feet in the monitoring app 302 could be reset to the correct value.

The integration of the device GPS 310 and the wearable sensor devices 102 provides several benefits. First, it may be another potential method of calibration. For example, if the net horizontal motion of the sensor devices 102, measured by the accelerometers 106, leads to the determination that the user has travelled a certain distance, this determination can be checked against the device GPS 310, and changes can be made to the data or the real-time acquisition programs to calibrate the system. The onboard device GPS 310 also increases the safety of the user. If the user was undergoing a strenuous activity and suddenly, and/or for an extended period of time, stopped, the monitoring app 302 may determine that a problem has occurred. The monitoring app 302 could then alert the authorities or others and provide the user's location.

There are many types of user input devices 312 that may be combined for use with the present invention. One type may be the touch-screen capability present in modern smartphones. Here, the user could adjust settings, program routines, select exercises, etc. Various user input devices 312 which may be integrated with present invention, for interfacing with the monitoring app 302 or the wearable sensor devices 102, should be considered equivalent and within the scope thereof.

The user output devices may be speakers, earbuds, external connections to computers, etc. The user output device is a key component of providing feedback to the user and/or others, who may be monitoring the user. Various user output devices may be integrated with present invention and should be considered equivalent and within the scope thereof.

The device transceiver 314 may be an integrated wireless transmitter/receiver combination, though a wired connection may be possible or desired in some instances. The device transceiver 314 may be used to communicate with the transceiver 112 on the wearable sensor devices 102, and/or other computers or monitoring devices. Such transceivers are known to those ordinarily skilled in the art and their equivalents should be considered within the scope of the present invention.

The local database 320 may be included for receiving and storing data temporarily, such as medical programs, therapy routines, logs from earlier use, a physical activity database including a different labeled sets of predefined physical activity patterns, where each such set corresponds to a physical activity, predefined time thresholds, predefined acceleration data thresholds, and information about the user; however, this is not required, and all data may be retained in another location if desired.

The above components may be interconnected via the data bus 322, which is a generic term for a conduit of information or electronic signals. There are many possible implementations of the data bus 322 by those ordinarily skilled in the art, and such implementations should be considered equivalent and within the scope of the present invention.

As illustrated in FIG. 3, the computer memory 318 of the portable electronic device 120 may be used to extend the utility of the portable electronic device 120. In this case, the computer memory of the portable electronic device 120 receives the monitoring app 302 and/or an internet browser for browsing web pages that may include additional medical or training programs. Additional programs may also be included, such as medical diagnostic programs, exercise routines, therapy routines, training programs, and others, some of which are discussed in greater detail below.

We begin a discussion of alternate embodiments of the present invention, by introducing an embodiment where the monitoring app 302 verifies connectivity with the transceiver 112 of the wearable sensor devices 102 and the device transceiver 314. In this embodiment, the monitoring app 302 continually monitors the acquisition of data. Should data acquisition be interrupted, the monitoring app 302 will make a predetermined number of attempts, three for example, to regain connectivity. Should this fail, an alarm or other visual, haptic, or audio cue will be produced, alerting the user to move the portable electronic device 120 closer to the wearable sensor devices 102 in order to regain the data connection.

In the embodiment of FIG. 3, the monitoring app 302 may be used to generate a graphical user interface on the device display 304 of the portable electronic device 120 to enable the user to interact with the monitoring app 302. In this embodiment, the graphical user interface may be used to show the user the position of their body, in two or three dimensions, while they are performing the actions required by the instruction program. Also, such instruction may be in the form of audio commands from the speaker 306, visual cues on the monitor of the portable electronic device 120, beeping or other audio cues from the speaker 306 that would indicate pacing or other information, or vibration of the portable electronic device 120. The information given to the user by the monitoring app 302 need not be just instruction, but could also indicate when to start or stop an activity, audio or visual feedback of the results of a completed activity, information on suggested future activities or programs to utilize, or trends of a user's progress in performing various activities.

With the acceleration data received from the accelerometer 106, the monitoring app 302 may guide the user as they perform the activity, and reconstruct their motion as it is saved in the computer memory 318. The monitoring app 302 may also provide feedback and encouragement to the user, telling them how to better perform the activity, giving them the time remaining, or coaxing them to continue even if the monitoring app 302 determines they are becoming fatigued.

In physical therapy it is just as important to not perform an activity incorrectly as it is to perform it correctly. Learning an incorrect way to move may slow the healing process, or even further injure the user. By monitoring the user's motions, the monitoring app 302 can instruct the user to stop if they are performing an activity too wrong, and if the problem cannot be corrected by the feedback provided, to seek the assistance of a medical practitioner before resuming exercises.

In a related embodiment, a companion app 324 may be installed on another instance of the portable electronic device 120, for providing a convenient way of monitoring a patient or user who is using the monitoring app 302, for example a doctor or nurse with the companion app 324 installed on a mobile device, such as a cell phone, laptop computer, tablet computer, etc. The companion app 324 may include the following functionality: the ability to report notifications of the physical activity status and acceleration data, as with the monitoring app 302, the ability to receive text, SMS, or other types of instant messaging or alerts to inform the user of the companion app 324 that the user of the monitoring app 302 has missed an exercise or other scheduled activity such as running, the ability to video the patient performing exercises, with the videos able to be sent to health care providers or others, and the ability to receive notifications from providers or others requesting videos or other data from the patient, practitioner, trainer, or any user of the companion app 324 or monitoring app 302. Other functions of the companion app 324 and their modes of implementation may be added or modified by those skilled in the art, and should be considered equivalent and within the scope of the present invention.

With the monitoring app 302 connected to a network (shown in FIG. 4), the data may be monitored in real-time or afterwards by medical practitioners or others. This has the potential for not just the sharing of information with numerous practitioners, but also the monitoring of the user's progress when not on-site, such as therapy performed in the user's home or other location away from the treatment facility.

In yet another embodiment, the monitoring app 302 may contain a mode wherein the monitoring app 302 instructs the accelerometer 106 to turn on for only brief periods of time during a longer duration exercise such as running a marathon. This allows data on the user's performance to be sampled throughout the duration of their activity, without the risk of draining the battery 110 as may happen for activities of long duration. Typically the user has entered in the monitoring app 302 an estimate of the duration of their activity, usually measured in hours or fractions thereof.

In yet another embodiment, the monitoring app 302 may contain a mode useful for acquiring data for the user performing a physical activity. In one embodiment, the monitoring app 302 signals the user to begin running. In the case of sprinting, there is a time lag between the start of running and the attainment of the rhythmic full speed run. This occurs when the user is accelerating, getting their stride, etc. To save on memory space, data for some predetermined interval, for example two seconds, is not taken. After the two second delay, data is taken normally and throughout the end of the run. Optionally, data may be taken the entire time in order to capture the start as well, as feedback during that phase may be important to the user's performance. Also, if the user is primarily concerned with monitoring starts, the monitoring app 302 may only run for the first few seconds to record just that portion of the run.

The applications of the present invention go far beyond physical therapy. For instance the wearable sensor devices 102 may be used in the training of an athlete such as a martial artist, runner, or bicyclist. Here, the training is very similar to physical therapy, where technique can be monitored with feedback provided to the user and/or trainers. Also a history of the user's progress may be formed for use in charting progress and suggestions for further development.

FIG. 4 is a block diagram of one embodiment of a personal monitoring system 400 that includes the portable electronic device 120, a monitoring computer 406, and a remote computer 408 for monitoring the wearable sensor devices 102 and storing data. The wearable sensor devices 102, in the present embodiment, are operably connected (e.g., wirelessly) to the portable electronic device 120, such as via BLUETOOTH® or similar protocol.

In this embodiment, wherein the portable electronic device 120 is a cellular telephone, the portable electronic device 120 also streams data via a cellular network 402 (and/or another network 404, such as the Internet, or any form of local area network ("LAN") or a wireless network, to the other computers 406 and/or 408. Alternatively, in another embodiment, the portable electronic device 120 may communicate with the network 404 through a network device 410 such as a wireless transceiver or router. Here we consider two computers in the present embodiment of the invention, the remote computer 408 and the monitoring computer 406.

The remote computer 408 has a computer processor 412, a computer memory 414, a user interface 416 operably installed in the computer memory 414, a database 420 operably installed in the computer memory 414, and a remote display 418. The remote computer 408 functions primarily as a repository of data taken during the user's activity such as running Data stored on the remote computer 408 may be accessed via the network 404 by other computers, or viewed locally using the remote display 418.

The monitoring computer 406 has a computer processor 422, a computer memory 424, a browser 426 operably installed in the computer memory 424, and a monitoring program 428 operably installed in the computer memory 424. Also, the computer may be connected to a monitoring display 430 for viewing the data and/or the output of the monitoring program 428, and have a printer 432 for printing physical copies of the same. The browser 426 may be a typical internet browser or other graphical user interface ("GUI") that may allow communication over the internet to the patient, other health care practitioners, or trainers. The monitoring program 428 interprets the results of the data sent by the monitoring app 302 and provides analysis and reports to the user of the monitoring computer 406. The monitoring program 428 provides information not included in the monitoring app 302, for example diagnosis of conditions and suggestions for treatment, or comparison of results with other patients either in real-time or by accessing the database 420 of the remote computer 408.

One embodiment of the personal monitoring system 400 includes providing the various components, particularly the accelerometer 106 in the wearable sensor devices 102, a unique address programmed therein for identification. The personal monitoring system 400 includes a data collection system 440 for simultaneously monitoring both the first and second locations and, in addition to any other number of locations that may be desired, around the world.

In this embodiment, the data collection system 440 may include a cell phone, and the remote computer 408 for simultaneously monitoring both the first location and a second location. In alternative embodiment, any one of these elements, or combinations thereof, may be used, in addition to any additional computer devices for tracking the data.

In this embodiment, a unique address is stored in each of the various components, and may include an IP address, or any form of unique indicator (e.g., alphanumeric). The address may be stored in the memory 424, or in any other hardware known in the art, and is transmitted with the data so that the data may be associated with the data in a database (e.g., the local database 320 of the portable electronic device 120, or the database 420 of the remote computer 408).

Data from the various components may then be streamed to the remote computer 408 (or other component of the data collection system 440) for storage in the database 420. For purposes of this application, "streaming data" may be performed in real time, with data being constantly transmitted (e.g., in typical "packets"), or it may be aggregated and sent periodically, or it may be stored and periodically downloaded (e.g., via USB or other connection) and transmitted.

In one embodiment, the data may include acceleration data from the accelerometer 106. Selected data, such as the acceleration data, may be transmitted in real time, while more complex data, such as the movement data may be stored in the memory 108 until a suitable trigger, such as actuation of a pushbutton, passage of a predetermined period of time, or other trigger (e.g., at the end of an exercise), and then streamed as a single transmission. Transmitting the data in this manner has proven to greatly relieve demands on the wearable sensor devices 102, which might otherwise make management of the data extremely difficult, especially when large numbers of users are utilizing the system.

In one embodiment, the data may be periodically analyzed by the remote computer 408 (or other suitable computer system) for "alarm conditions" (e.g., information and/or deviations that may be of interest to the user and/or the doctor and/or any other form of administrator). If an alarm condition is detected, a pertinent alert may be sent to the monitoring computer 406, directly to the user (e.g., via text message, email, signal to the portable electronic device 120, etc.), or to any other suitable party. For example, if the user is putting too much force on an injured leg during rehabilitation, or performing the exercise incorrectly, an alert may be sent to the user for immediate action, and/or a message (e.g., training video, etc.) may be sent via email or other method to help the user perform the exercise correctly.

Figure 5:
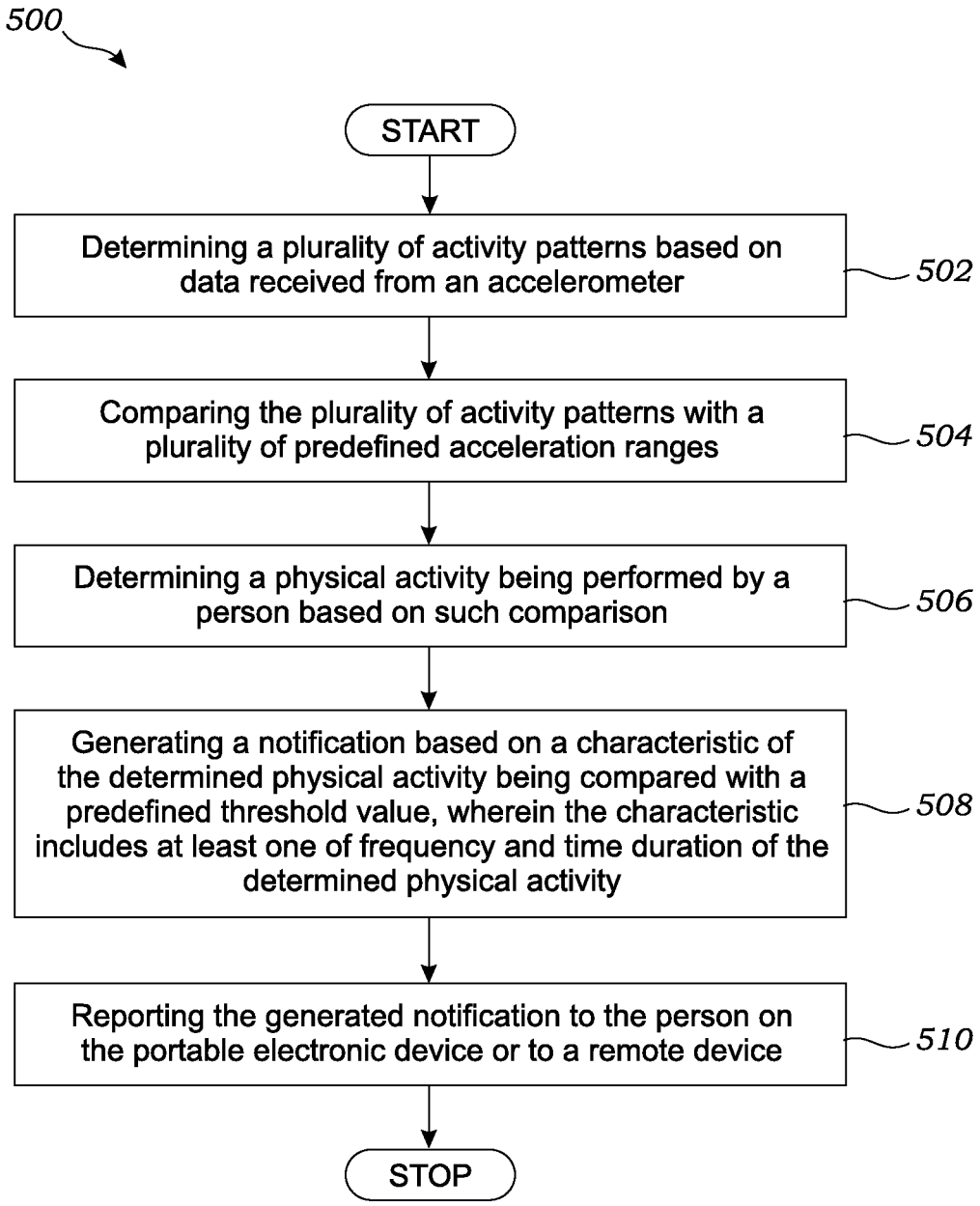
FIG. 5 is a flow diagram illustrating an exemplary method implemented by the portable electronic device of FIG. 1 for tracking and reporting a physical activity being performed by the user, according to one embodiment of the present invention.

FIG. 5 is a flow diagram illustrating an exemplary method implemented by the portable electronic device 120 of FIG. 1 for tracking and reporting a physical activity being performed by the user, according to one embodiment of the present invention. The exemplary method 500 may be described in the general context of computer executable instructions. Generally, computer executable instructions may include routines, programs, objects, components, data structures, procedures, modules, functions, and the like that perform particular functions or implement particular data types. The computer executable instructions may be stored on a computer readable medium, and installed or embedded in an appropriate device for execution. The order in which the method 500 is described is not intended to be construed as a limitation, and any number of the described method blocks may be combined or otherwise performed in any order to implement the method 500, or an alternate method. Additionally, individual blocks may be deleted from the method 500 without departing from the spirit and scope of the present disclosure described herein. Furthermore, the method 500 may be implemented in any suitable hardware, software, firmware, or combination thereof, that exists in the related art or that is later developed.

In the embodiment of FIG. 5, the method 500 is implemented of the portable electronic device 120 (of FIGS. 1, 3, and 4), using one or more of the wearable sensor devices 102 (as shown in FIG. 1); however, those having ordinary skill in the art would understand that the method 500 may be modified appropriately for implementation in a various manners without departing from the scope and spirit of the disclosure.

At step 502, a plurality of activity patterns are determined based on data received from the accelerometer 106 of the wearable sensor devices 102 (as shown in FIG. 2). The portable electronic device 120 receives the acceleration data from the accelerometer 106 based on the user performing a physical activity. The acceleration data being received within a predetermined acceleration range may be used to identify an active state in which the user is performing a predetermined physical activity, where the predetermined acceleration range may be bounded by a predefined minimum acceleration threshold value and a predefined maximum acceleration threshold value. The predetermined acceleration range may be segmented into one or more, distinct or overlapping, sub-ranges, each corresponding to a predefined physical activity. These acceleration sub-ranges may be predefined and stored in the memory of the portable electronic device 120 or the remote computer 408.

At step 504, the determined plurality of activity patterns are compared with a plurality of predefined acceleration ranges stored in a memory 318 of the portable electronic device 120, where each acceleration range corresponds to a predefined physical activity. At step 506, the physical activity being performed by a user is determined based on such comparison.

The portable electronic device 120 may compare the received acceleration data with each of the sub-ranges within the predetermined acceleration range to determine a physical activity being performed by the user. For example, within an acceleration range of 3 $m/s^2$ to 10 $m/s^2$, a first acceleration sub-range of 3 $m/s^2$ to 5 $m/s^2$ may be defined for walking and a second acceleration sub-range of 6 $m/s^2$ to 10 $m/s^2$ may be defined for jogging.

The portable electronic device 120 may calculate a frequency of the received acceleration data within each of the predefined acceleration sub-ranges and determine the physical activity based on the frequency exceeding a predetermined minimum frequency value. For example, when the frequency of the received acceleration data within the first range exceeds a predetermined minimum frequency value, e.g., two, the portable electronic device 120 may determine a physical activity being performed by the user as walking. Similarly, when the frequency of received acceleration data within the second sub-range exceeds two, the portable electronic device 120 may determine a physical activity being performed by the user as jogging.

Various arm motions may indicate that certain exercises are being performed, and the acceleration data may indicate if the exercises are being performed correctly, with suitable vigor, and may also determine a range of motion of each of the user's arms. Then range of motion data may be tracked and reported to determine the success of the exercises, especially if being performed for rehabilitation purposes. Furthermore, the range of motion data may be used to measure bilateral equivalence, to determine whether the user is developing strength and flexibility equally on both sides. Bilateral equivalence has been found to be of great importance in physical fitness, and especially rehabilitation, and so the measurement of and tracking of this information is of significant importance.

The data gathered by the system may be stored on the portable electronic device 120, and/or may also be reported to the monitoring computer 406 (of FIG. 4), or any other suitable computer(s), for storage, tracking, and reporting.

The portable electronic device 120 may generate a new data notification for the user when a frequency of the received acceleration data does not correspond to any of the predefined acceleration sub-ranges. The new data notification may indicate to the user that the physical activities are not being performed frequently enough, or for a long enough period of time (or too frequently/too long), or are not being performed correctly. Corrective action may be taken, such as arranging further motivation (e.g., via added incentives, reminders, etc.), training (e.g., a training video, or follow up by a trainer), etc., to correct the discrepancies. The new data notification may be an audio indication (e.g., a beep, etc.), a visual notification (e.g., a blinking light, a text message, etc.), and a haptic indication (e.g., a vibration alert, etc.), or via email, and/or reports to other persons (e.g., trainers, doctors, etc.).

In some embodiments, the portable electronic device 120 may store such new acceleration data in the memory 318 of the portable electronic device 120 and request an input from the user for labeling the new acceleration data. Based on the received user input, the portable electronic device 120 may label the new acceleration data with a user-defined physical activity. In some embodiments, the portable electronic device 120 may also define an acceleration sub-range for the user-defined physical activity based on the new acceleration data.

At 508, a notification is generated based on a characteristic of the determined physical activity being compared with a maximum threshold value. The portable electronic device 120 may compare a characteristic such as a frequency of the received acceleration data within each of the predefined acceleration sub-ranges with a maximum frequency threshold value, where each acceleration sub-range corresponds to a predefined physical activity.

When the frequency is less than the maximum frequency threshold value, the portable electronic device 120 generates a reminder notification for the user's attention. The reminder notification indicates the user that a predefined schedule of the physical activity is incomplete. The reminder notification may be an audio indication (e.g., a beep, etc.), a visual notification (e.g., a blinking light, a text message, etc.), and a haptic indication (e.g., a vibration alert, etc.). The user may accordingly perform a specific physical activity related to the acceleration data within a corresponding acceleration sub-range and complete the associated predefined activity schedule.

When the frequency is equivalent to or more than the minimum frequency threshold value, the portable electronic device 120 generates a reward message for the user. The reward message may indicate to the user that a predefined schedule of the physical activity being performed by the user is complete (or acceptable). The reward message may be an audio indication (e.g., a beep, etc.), a visual notification (e.g., a blinking light, a text message, etc.), and a haptic indication (e.g., a vibration alert, etc.). The user may include a congratulatory message, a coupon for lowering health insurance rates, a monetary voucher, reward points, a user rating, or any combination thereof. The reward message may be an audio indication (e.g., a beep, etc.), a visual notification (e.g., a blinking light, a text message, etc.), a haptic indication (e.g., a vibration alert, etc.), and/or any form of email the delivery of any other form of rewards known in the art. In some embodiments, the reward message may include a plurality of dynamically-selectable predetermined reward messages.

At step 510, the generated notification is reported to the user on the portable electronic device 120 or to a remote device. The portable electronic device 120 may report at least one of the new data notification, the reminder notification, and the reward message to the user on the portable electronic device 120 or to a remote device such as the remote computer 408.

Figure 6:
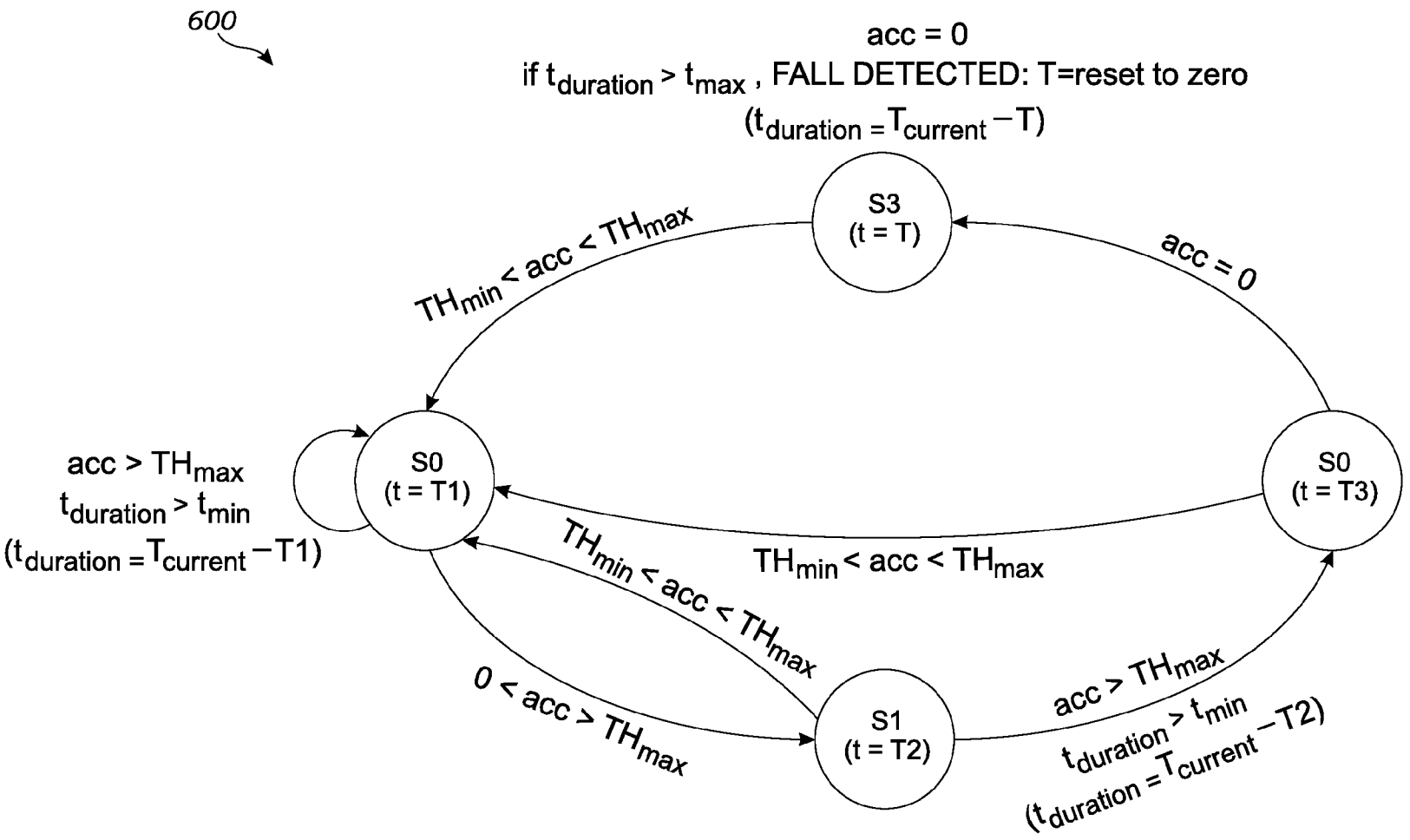
FIG. 6 is a state transition diagram in a finite state machine being implemented by the portable electronic device of FIG. 1, according to one embodiment of the present invention.
Figure 7:
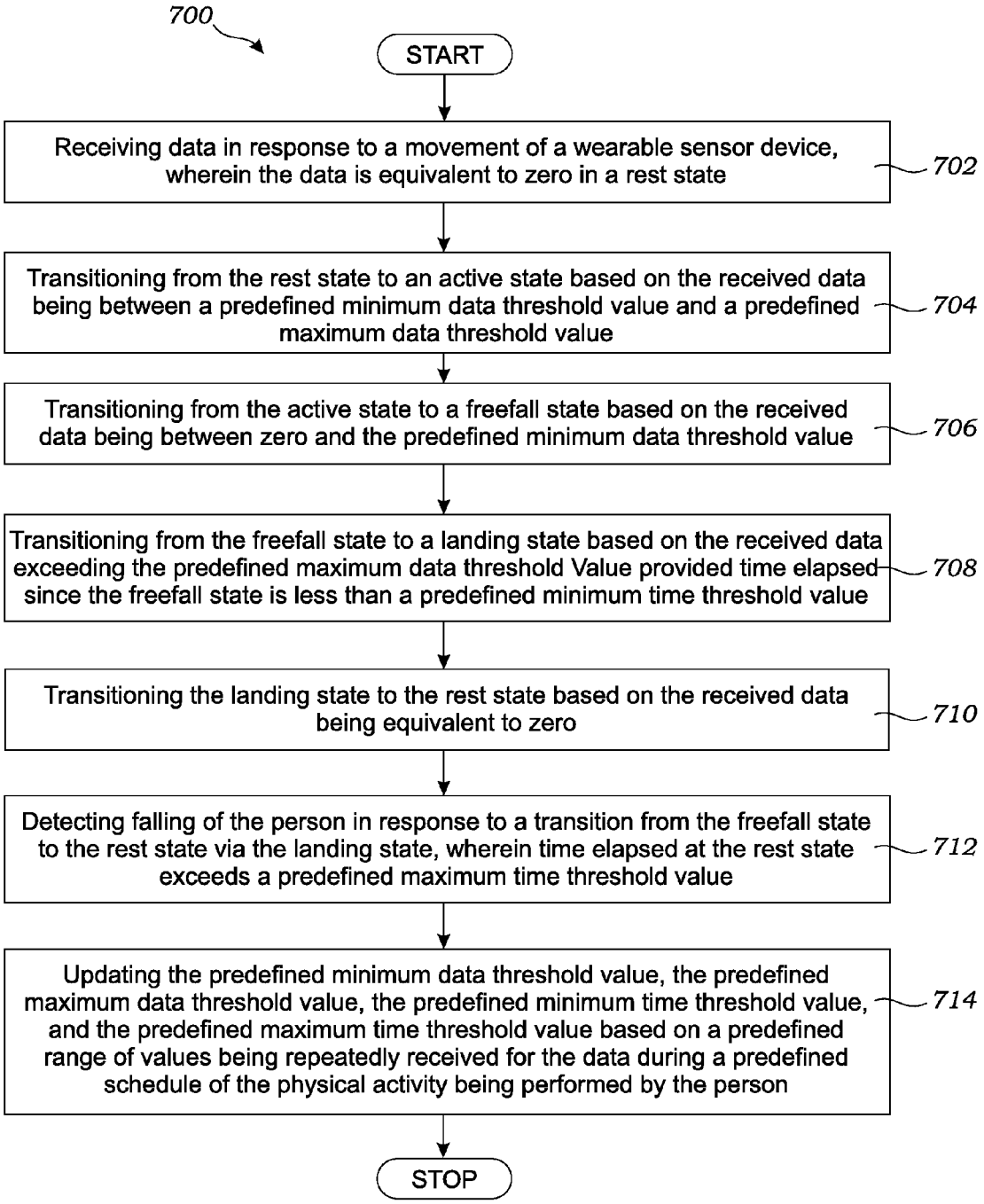
FIG. 7 is a flow diagram illustrating an exemplary method implemented by the portable electronic device of FIG. 1 for being trained to detect falling of the user while performing a physical activity, according to one embodiment of the present invention.

FIG. 6 is a state transition diagram 600 in a finite state machine (FSM) being implemented on the portable electronic device 120 of FIG. 1, according to one embodiment of the present invention. The state transition diagram 600 will be explained in conjunction with method steps illustrated in FIG. 7, which is a flow diagram illustrating an exemplary method implemented by the portable electronic device 120 of FIG. 1 for being trained to detect falling of the user performing a physical activity.

The state transition diagram 600 illustrates operational states for training the portable electronic device 120 to detect falling of the user performing a physical activity. With reference to the state transition diagram, a transition from one state to the next depends on a value of a received acceleration data signal from the accelerometer 106 with respect to earth's gravity and a time elapsed "t" at the last transition state, wherein the elapsed time is calculated by a clock timer (not shown) on the portable electronic device 120.

The frequency of evolution of the FSM is a function of the refresh frequency of the acceleration data signals received from the accelerometer 106 (and consequently depends on the type of accelerometer implemented). The frequency of calculating the elapsed time may depend, for example, on the duration of the events that are to be detected. In this way, each time the value of the acceleration data is updated, the FSM may reconsider its state, in close association with the time elapsed at the last transition state.

The exemplary method 700 may be described in the general context of computer executable instructions. Generally, computer executable instructions may include routines, programs, objects, components, data structures, procedures, modules, functions, and the like that perform particular functions or implement particular data types. The computer executable instructions may be stored on a computer readable medium, and installed or embedded in an appropriate device for execution. The order in which the method 700 is described is not intended to be construed as a limitation, and any number of the described method blocks may be combined or otherwise performed in any order to implement the method 700, or an alternate method. Additionally, individual blocks may be deleted from the method 700 without departing from the spirit and scope of the present disclosure described herein. Furthermore, the method 700 may be implemented in any suitable hardware, software, firmware, or combination thereof, that exists in the related art or that is later developed.

The method 700 describes may be implemented of the portable electronic device 120, as described above, or in other similar or equivalent systems or devices. Furthermore, those having ordinary skill in the art would understand that the method 700 may be modified to incorporate similar equivalent or equivalent steps and/or processes, and such alternatives should be considered within the scope of the present invention.

At step 702, data is received in response to a movement of a wearable device, wherein the data is equivalent to zero in a falling state. At an initial falling state S3, the FSM awaits acceleration data being received from the accelerometer 106 in response to movement of the wearable sensor devices 102 due to the user performing a physical activity. S3 is the falling state at which the acceleration data is equivalent to zero relative to the gravity of earth. The portable electronic device 120 remains at the falling state S3 until the acceleration data in any of the X, Y, and Z axes increases beyond a minimum data threshold value ($Th_{min}$). The portable electronic device 120 initiates a clock timer starting from zero as the value of the received acceleration data starts to increase.

At step 704, the falling state is transitioned to an active state based on the received data being between a predefined minimum data threshold value and a predefined maximum data threshold value. As the value of the received acceleration data gradually increases beyond the minimum data threshold value ($Th_{min}$) but less than a maximum threshold data value ($Th_{max}$), the portable electronic device 120 moves from the falling state S3 to an active state S0. The time elapsed since the portable electronic device 120 has transitioned to the active state S0 may be calculated by the portable electronic device 120 using a clock timer as shown in equation 1, where T1 is the timer value when the active state S0 was first attained by the portable electronic device 120.

$$t_{time\ elapsed,S0}=T_{current}-T_1 \quad (1)$$

The portable electronic device 120 may remain at the active state S0 even if the acceleration data value increases to become more than the maximum acceleration threshold value ($Th_{max}$) but the time duration, as shown in equation 1, in which such increase is achieved is greater than a predefined minimum time threshold value ($t_{min}$) as shown in equation 2.

$$t_{time\ elapsed,S0}>t_{min} \quad (2)$$

At step 706, the active state is transitioned to a freefall state based on the received data being between zero and a predefined minimum data threshold value. The portable electronic device 120 may receive acceleration data having value less than a predefined minimum data threshold value ($Th_{min}$) but greater than zero indicating a freefall condition. Upon being detected the freefall condition, the portable electronic device 120 may transition from the active state S0 to a freefall state S1. The time elapsed since the transition is made to the freefall state S1 may be calculated by the portable electronic device 120 using the clock timer as shown in equation 3, where T2 is the timer value when the freefall state S1 was attained by the portable electronic device 120.

$$t_{time\ elapsed,S1}=T_{current}-T2 \quad (3)$$

Such a freefall condition may indicate that the user is midair indicating a potential fall or a jump made by the user. If the acceleration data increases over the minimum data threshold value ($Th_{min}$) as discussed in step 704, the portable electronic device 120 moves back to the active state S0.

At step 708, the freefall state is transitioned to a landing state based on the received data exceeding the predefined maximum data threshold value provided the time elapsed since the freefall state is less than a minimum time threshold.

While being at the freefall state S1, as the acceleration data value exceeds the predefined maximum data threshold value ($Th_{max}$), the portable electronic device 120 may check for the time elapsed since the freefall state S1 is achieved. If this time elapsed within which such increase in the acceleration data value is achieved is less than the predefined minimum time threshold value ($t_{min}$), as shown in equation 4, the portable electronic device 120 may transition from the freefall state S1 to a landing state S2.

$$t_{time\ elapsed,S1}<t_{min} \quad (4)$$

The time elapsed since the portable electronic device 120 has transitioned to the landing state S2 may be calculated by the portable electronic device 120 using a clock timer as shown in equation 5, where T3 is the timer value when the landing state S2 was attained by the portable electronic device 120.

$$t_{time\ elapsed,S2}=T_{current}-T3 \quad (5)$$

At step 710, the landing state is transitioned to the falling state based on the received data being equivalent to zero. While being at the landing state S2, the portable electronic device 120 may transition to the falling state S3 if the received acceleration data is equivalent zero. The time elapsed since the portable electronic device 120 has transitioned to the falling state S3 may be calculated by the portable electronic device 120 using a clock timer as shown in equation 6, where T is the timer value when the falling state S3 is attained by the portable electronic device 120.

$$t_{time\ elapsed,S3}=T_{current}-T \quad (6)$$

At step 712, falling of the user is detected in response to a transition from the freefall state to the falling state via the landing state such that the time elapsed since the transition to the falling state. The portable electronic device 120 may use state transitions in a predetermined order for detecting the falling of the user performing a physical activity. For example, the portable electronic device 120 may transition from an initial active state S0 to the freefall state S1, followed by a transition to the landing state S2, and then the transition to the falling state S3. Upon such state transitions in the predetermined order in which at least one of the states is the falling state S3, the portable electronic device 120 determines the time elapsed at the falling state S3.

If the time elapsed at the falling state S3, shown in equation 6, exceeds the predefined maximum time threshold ($t_{max}$), as shown in equation 7, while the acceleration at the falling state S3 being zero, the portable electronic device 120 detects falling of the user.

$$t_{time\ elapsed,S3}>t_{max} \quad (7)$$

At step 714, the minimum data threshold, the maximum data threshold, the minimum time threshold, the maximum time threshold are updated based on a predefined range of values being repeatedly received for the data during a predefined schedule of the physical activity being performed by the user. The portable electronic device 120 may use the received acceleration data as training data as the user performs a predetermined schedule of a predefined physical activity. Based on the acceleration data values received during the physical activity, the portable electronic device 120 may adaptively update values of the predefined minimum data threshold, the predefined maximum data threshold, the predefined minimum time threshold, the predefined maximum time threshold based on a performance pattern of the physical activity as done by the user. The portable electronic device 120 may use the training data for being trained using any of a variety of machine learning algorithms known in the art, related art, or developed later including backpropagation and genetic algorithms.

Figure 8:
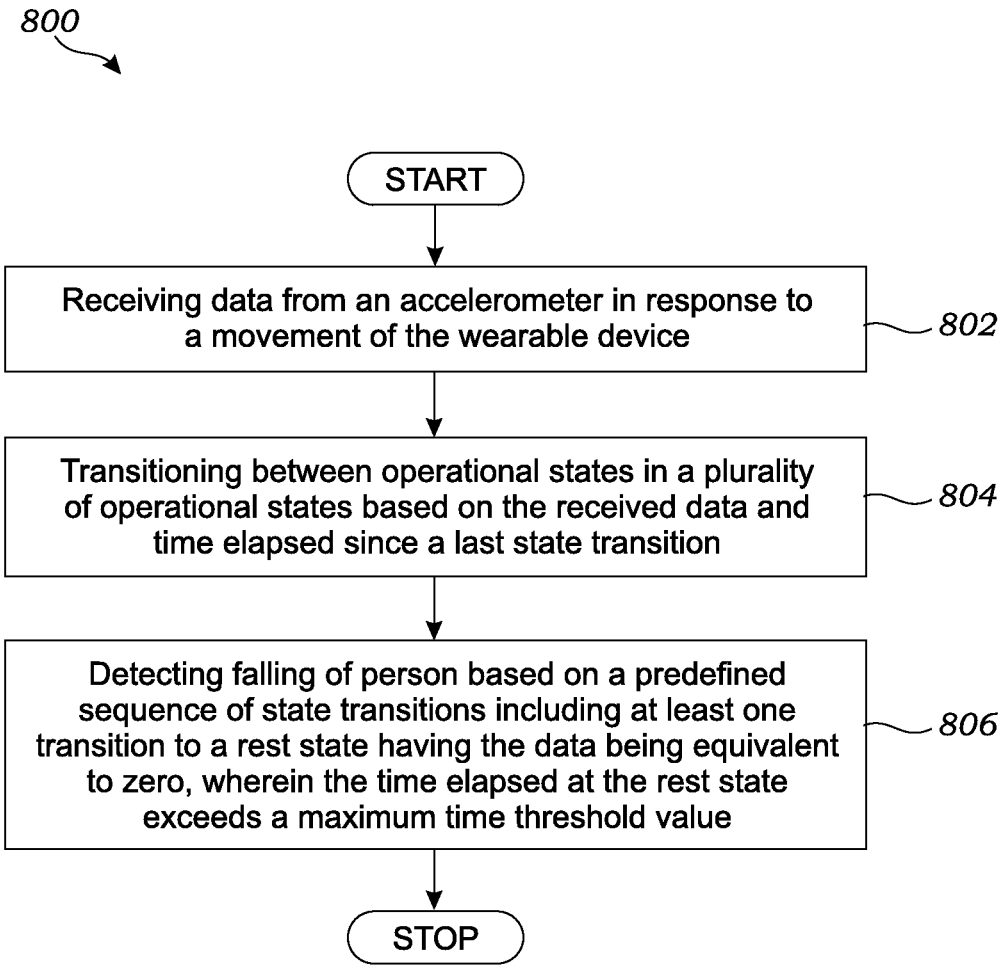
FIG. 8 is a flow diagram illustrating an exemplary method implemented by the portable electronic device of FIG. 1 for detecting the falling of the user while performing a physical activity, according to one embodiment of the present invention.

FIG. 8 is a flow diagram illustrating an exemplary method implemented by the portable electronic device 120 of FIG. 1 for detecting the falling of the user while performing a physical activity. The exemplary method 800 may be described in the general context of computer executable instructions. Generally, computer executable instructions may include routines, programs, objects, components, data structures, procedures, modules, functions, and the like that perform particular functions or implement particular data types. The computer executable instructions may be stored on a computer readable medium, and installed or embedded in an appropriate device for execution. The order in which the method 800 is described is not intended to be construed as a limitation, and any number of the described method blocks may be combined or otherwise performed in any order to implement the method 800, or an alternate method.

Additionally, individual blocks may be deleted from the method 800 without departing from the spirit and scope of the present disclosure described herein. Furthermore, the method 800 may be implemented in any suitable hardware, software, firmware, or combination thereof, that exists in the related art or that is later developed.

The method 800 describes, without limitation, implementation of the portable electronic device 120. Those having ordinary skill in the art would understand that the method 800 may be modified appropriately for implementation in a various manners without departing from the scope and spirit of the disclosure.

At step 802, data from an accelerometer is received in response to a movement of the wearable sensor device. The portable electronic device 120 may receive acceleration data from an accelerometer 106 associated with the wearable sensor devices 102 worn by a user. The accelerometer 106 may capture the acceleration data in X, Y and Z axes based on the movement of the wearable sensor devices 102 as the user performs a physical activity. The acceleration data may be received by the portable electronic device 120 via its transceiver 314 in communication with the transceiver 112 of the wearable sensor devices 102.

At step 804, transitioning between operational states in a plurality of operational states based on the received data and the time elapsed since the last transition. The portable electronic device 120 may transition between different operational states based on the received acceleration data and the time elapsed since the last state transition. For example, the portable electronic device 120 may transition from the falling state S3 to the active state S0 as the acceleration data increases to a value exceeding the predefined minimum data threshold value until such an increase exceeds the predefined maximum data threshold value gradually so that the time elapsed since the transition to the active state S0 is greater than a predefined minimum time threshold. Similar transitions to other states including the freefall state S1, the landing state S2, and the falling state S3 are discussed above in the descriptions of FIGS. 6 and 7.

At step 806, falling of the user is detected based on a predefined or dynamically defined sequence of state transitions including at least one transition to the falling state having data being equivalent to zero, such that the time elapsed at the falling state S3 exceeds a predefined maximum time threshold. The sequence of state transitions may be dynamically defined based on the portable electronic device 120 being dynamically trained using the received acceleration data in real time based on any of a variety of machine learning algorithms known in the art, related art, or developed later. The portable electronic device 120 may use the training data for being trained using any of a variety of machine learning algorithms known in the art, related art, or developed later including backpropagation and genetic algorithms.

The computer or computers used in the personal monitoring system may be any form of computers or computers, servers, or networks known in the art. As used in this application, the terms computer, processor, memory, and other computer related components, are hereby expressly defined to include any arrangement of computer(s), processor(s), memory device or devices, and/or computer components, either as a single unit or operably connected and/or networked across multiple computers (or distributed computer components), to perform the functions described herein.

The exemplary embodiments described herein detail for illustrative purposes are subject to many variations of structure and design. It should be emphasized, however that the present invention is not limited to particular method of manufacturing wearable sensor devices as shown and described. Rather, the principles of the present invention can be used with a variety of methods of manufacturing wearable sensor devices. It is understood that various omissions, substitutions of equivalents are contemplated as circumstances may suggest or render expedient, but the present invention is intended to cover the application or implementation without departing from the spirit or scope of the claims.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. The term 'shoes' or 'footwear' may have been used above interchangeably and refer to convey the same meaning. The term "activity" as used in this application refers to any activity that the user of the present invention may be undertaking, whether it is exercise, training, physical therapy, or routine activities. Also, pressure and force may be used interchangeably as pressure is simply a scalar quantity that relates the applied force to a known surface area. Furthermore, the terminology used in the specification provided above is hereby defined to include similar and/or equivalent terms, and/or alternative embodiments that would be considered obvious to one skilled in the art given the teachings of the present patent application.

What is claimed is:

1. A computer-implemented method for detecting falling of a person during a physical activity, wherein the person is in communication with a wearable device having an accelerometer and a transmitter for transmitting data from the accelerometer, the method comprising:

receiving, with a transceiver on a portable electronic device, data from the accelerometer in response to a movement of the wearable device;

transitioning, with a processor on the portable electronic device, between operational states in a plurality of operational states based on the received data and time elapsed since a last state transition;

detecting, with the processor, falling of the person based on a predefined sequence of state transitions including at least one transition to a falling state having the data being equivalent to zero, wherein the time elapsed at the falling state exceeds a predefined maximum time threshold; and transmitting a report of the falling of the person;

wherein the predefined sequence includes transitions from a freefall state to the falling state via a landing state, wherein the freefall state has a data value being between zero and a minimum data threshold, and the landing state has a data value exceeding a predefined maximum data threshold.

2. The method of claim 1, further comprising calculating, with a clock timer on the portable electronic device, the time elapsed since the last state transition.

3. The method of claim 1, wherein the data includes one of an average magnitude of acceleration, a variance of magnitude of acceleration, a variance of direction of acceleration, or any combination thereof, wherein the acceleration is measured relative to the gravity of earth.

4. The method of claim 1, further comprising:

determining, with the processor on the portable electronic device, a plurality of activity patterns based on the received data;

comparing, with the processor on the portable electronic device, the plurality of activity patterns with a plurality of predefined acceleration ranges;

determining, with the processor on the portable electronic device, the physical activity being performed by the user based on such comparison;

generating, with the processor on the portable electronic device, a first notification based on a characteristic of the determined physical activity being less than a predefined threshold value, wherein the characteristic includes at least one of frequency and time duration of the determined physical activity; and reporting, with the processor on the portable electronic device, the generated first notification to the person on the portable electronic device or to a remote device.

5. The method of claim 4, wherein the step of generating further comprises:

generating, with the processor on the portable electronic device, a reward message based on the characteristic of the determined physical activity being equivalent to or more than the predefined threshold value, wherein the reward message includes a congratulatory message, a coupon for lowering health insurance rates, a monetary voucher, reward points, a user rating, or any combination thereof.

6. The method of claim 5, wherein the reward message includes a plurality of dynamically-selectable predetermined reward messages.

7. The method of claim 4, the step of generating further comprises:

generating, with the processor on the portable electronic device, a second notification based on the plurality of activity patterns being different from the plurality of predefined activity patterns;

storing, with the processor on the portable electronic device, the plurality of activity patterns in a memory of the portable electronic device; and labelling, with the processor on the portable electronic device, each set of distinct activity patterns in the plurality of activity patterns, wherein the labelled each set of distinct activity patterns corresponds to a user-defined physical activity.

8. The method of claim 4, wherein the first notification and the second notification include an audio indication, a visual indication, a haptic indication, or a combination thereof.

9. A computer-implemented method for detecting a fall of a person, the method comprising the steps of:

providing a wearable sensor device that includes an accelerometer and a transmitter for transmitting data from the accelerometer, and which is adapted to be worn by the person;

portable electronic device that includes a transceiver for receiving the data from the accelerometer of the sensor device;

receiving, with the transceiver on the portable electronic device, data from the accelerometer in response to a movement of the wearable device, wherein the data is equivalent to zero in a falling state;

transitioning, with a processor on the portable electronic device, from the falling state to an active state based on the received data being between a predefined minimum data threshold and a predefined maximum data threshold;

transitioning, with the processor, from the active state to a freefall state based on the received data being between zero and the predefined minimum data threshold;

transitioning, with the processor, from the freefall state to a landing state based on the received data exceeding the predefined maximum data threshold provided time elapsed since the freefall state is less than a predefined minimum time threshold;

transitioning, with the processor, the landing state to the falling state based on the received data being equivalent to zero; and detecting, with the processor, falling of the person in response to a transition from the freefall state to the falling state via the landing state, wherein time elapsed at the falling state exceeds a predefined maximum time threshold.

10. The method of claim 9, wherein the one or more of the predefined minimum data threshold, the predefined maximum data threshold, the predefined minimum time threshold, and the predefined maximum time threshold are updated based on a predefined range of values being repeatedly received for the data during a predefined schedule of the physical activity being performed by the person.

11. The method of claim 9, further comprising calculating, with a clock timer on the portable electronic device, the time elapsed since a transition at each state from a group comprising the falling state, the active state, the freefall state, and the landing state.

12. The method of claim 9, wherein the data includes one of an average magnitude of acceleration, a variance of magnitude of acceleration, a variance of direction of acceleration, or any combination thereof, wherein the acceleration is measured relative to the gravity of earth.

13. A system for detecting falling of a person during a physical activity, the system comprising:

a wearable device in communication with the person, wherein the wearable device includes an accelerometer and a transmitter for transmitting data from the accelerometer; and a portable electronic device having a processor and a memory for receiving the data transmitted from the transmitter of the wearable device, wherein the portable electronic device is configured to:

receive the data from the accelerometer in response to a movement of the wearable device;

transition between operational states in a plurality of operational states based on the received data and time elapsed since a last state transition;

detect falling of the person based on a predefined sequence of state transitions including at least one transition to a falling state having the data being equivalent to zero, wherein the time elapsed at the falling state exceeds a predefined maximum time threshold; and transmitting a report of the falling of the person;

wherein the predefined sequence includes transitions from a freefall state to the falling state via a landing state, wherein the freefall state has a data value being between zero and a minimum data threshold, and the landing state has a data value exceeding a predefined maximum data threshold.

14. The system of claim 13, further configured to:

determine a plurality of activity patterns based on the received data;

compare the plurality of activity patterns with a plurality of predefined acceleration ranges;

determine the physical activity being performed by the user based on such comparison;

generate a first notification based on a characteristic of the determined physical activity being less than a predefined threshold value, wherein the characteristic includes at least one of frequency and time duration of the determined physical activity; and report the generated first notification to the person on the portable electronic device or to a remote device.

15. The system of claim 14, wherein the portable electronic device is further configured to:

generate a reward message based on the characteristic of the determined physical activity being equivalent to or more than the predefined threshold value, wherein the reward message includes a congratulatory message, a coupon for lowering health insurance rates, a monetary voucher, reward points, a user rating, or any combination thereof.

* * * * *